US005377642A

United States Patent [19]

Morrow et al.

[11] Patent Number: 5,377,642

[45] Date of Patent: Jan. 3, 1995

[54] COMPRESSION RELEASE FOR AN INTERNAL COMBUSTION ENGINE

[75] Inventors: John A. Morrow; Jack E. Campbell, both of Fort Mill, S.C.

[73] Assignee: Textron Inc., Providence, R.I.

[21] Appl. No.: 93,779

[22] Filed: Jul. 19, 1993

[51] Int. Cl.[6] ..... F02B 75/06

[52] U.S. Cl. ..... 123/182.1

[58] Field of Search ..... 123/182.1

[56] References Cited

U.S. PATENT DOCUMENTS

| | | | |
|---|---|---|---|
| 1,377,139 | 5/1921 | Murphy . | |
| 2,023,048 | 12/1935 | Gentili | 123/67 |
| 2,742,380 | 4/1956 | Peters | 123/182 |
| 3,417,740 | 12/1968 | Perlewitz | 123/182 |
| 3,538,899 | 11/1970 | Burkett | 123/182 |
| 3,782,354 | 1/1974 | Tuckey | 123/182.1 |
| 4,204,384 | 5/1980 | Holtermann | 123/182.1 |
| 4,217,796 | 8/1980 | Donohue | 123/182.1 |
| 4,252,092 | 2/1981 | Kaufman et al. | 123/182 |
| 4,312,308 | 1/1982 | Slattery | 123/182.1 |
| 4,414,933 | 11/1983 | Pribnow | 123/182.1 |
| 4,619,228 | 10/1986 | Liu | 123/182 |
| 4,791,892 | 12/1988 | Hall | 123/47 R |
| 4,993,372 | 2/1991 | Mott et al. | 123/65 BA |
| 5,054,441 | 10/1991 | Nakatani et al. | 123/182 |
| 5,134,976 | 8/1992 | Towner et al. | 123/65 PE |

*Primary Examiner*—David A. Okonsky
*Attorney, Agent, or Firm*—Perman & Green

[57] ABSTRACT

A compression release system is provided in an engine having a main exhaust port with an attached muffler. A muffler supporting boss extends from the cylinder of the engine separate from the muffler mounting at the main exhaust port. A compression release port extends through the boss. The muffler has two separate inlet apertures; one for the main exhaust port and one for the compression release port.

26 Claims, 1 Drawing Sheet

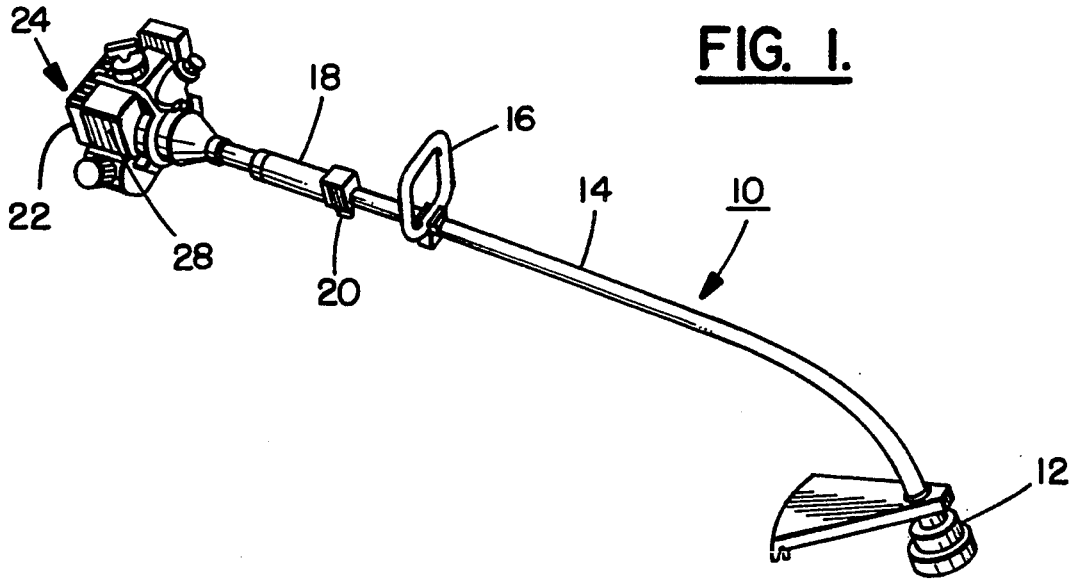
FIG. 1.
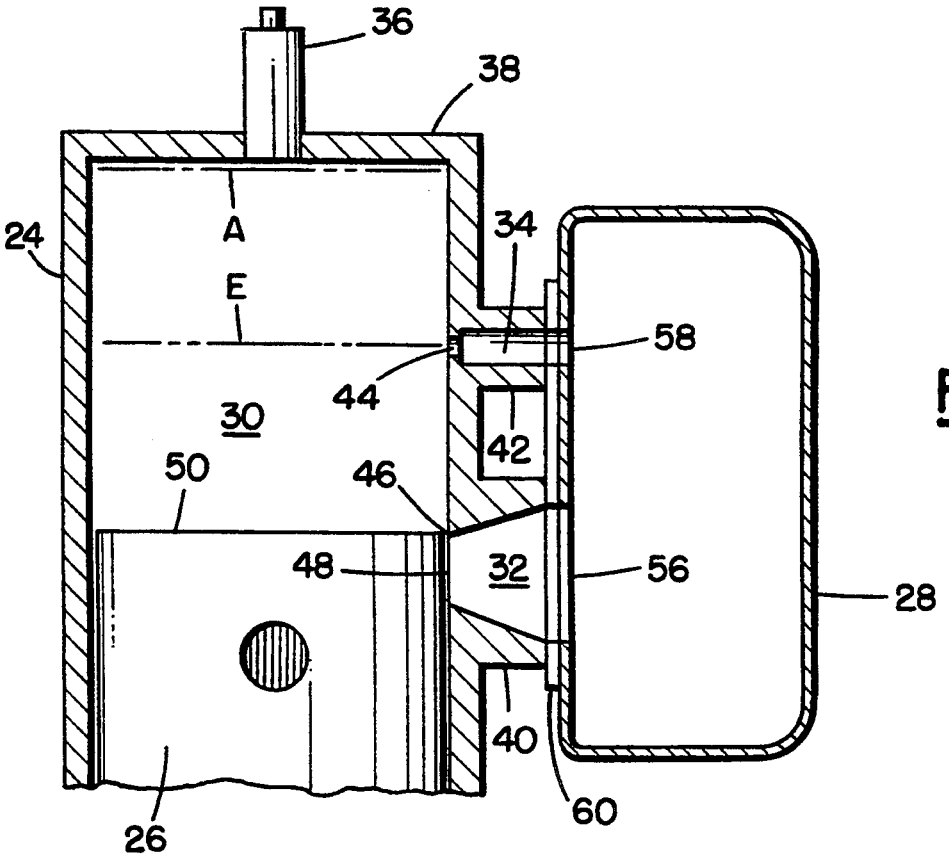
FIG. 2.
FIG. 3.
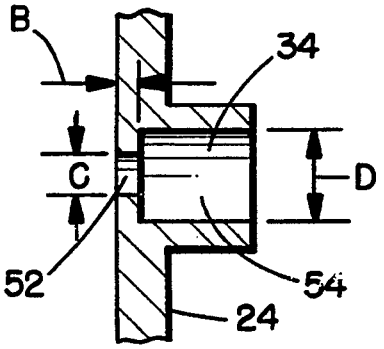
FIG. 4.
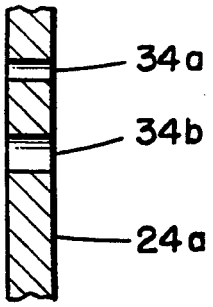

COMPRESSION RELEASE FOR AN INTERNAL COMBUSTION ENGINE

BACKGROUND OF THE INVENTION

1. Field of the Invention

The present invention relates to internal combustion engines and, more particularly, to a compression release system.

2. Prior Art

U.S. Pat. No. 4,252,092 discloses a compression release mechanism where gases from a compression release port are transported to a muffler of the engine. U.S. Pat. No. 3,538,899 discloses a similar mechanism with a valve located in the compression relief port. Other U.S. Pat. Nos. that relate to compression release include: 4,619,228; 2,742,380; 5,054,441; 4,993,372; 4,312,308; 3,417,740; 2,023,048; 1,377,139; 4,791,892 and 5,134,976. A muffler with two inlet apertures is also known in the prior art with one aperture connected to the main exhaust port of a two stroke engine and the other aperture connected to a port at the crankcase area of the engine.

SUMMARY OF THE INVENTION

In accordance with one embodiment of the present invention, a compression relief system for an internal combustion engine is provided comprising a cylinder and a muffler. The cylinder has a main exhaust port and a separate compression release port. The muffler is connected to the cylinder and includes a first inlet aperture connected to the main exhaust port and a separate second inlet aperture connected to the compression release port.

In accordance with another embodiment of the present invention, a power driven tool having an internal combustion engine is provided, the engine comprising a cylinder and a muffler. The cylinder has a muffler mounting section. The muffler mounting section includes a main exhaust port extending through a first portion and a compression release port extending through a second portion. The first and second portions are spaced from each other. The muffler is connected to the cylinder on the first and second portions and includes a first inlet aperture connected to the main exhaust port and a second inlet aperture connected to the compression release port.

BRIEF DESCRIPTION OF THE DRAWINGS

The foregoing aspects and other features of the invention are explained in the following description, taken in connection with the accompanying drawings, wherein:

FIG. 1 is a perspective view of a string trimmer having an engine incorporating features of the present invention.

FIG. 2 is a schematic cross sectional view of the cylinder, piston, and muffler of the engine shown in FIG. 1.

FIG. 3 is an enlarged sectional view of the compression release port shown in the cylinder of FIG. 2.

FIG. 4 is a partial schematic sectional view of an alternate embodiment of the present invention.

DETAILED DESCRIPTION OF THE INVENTION

Referring to FIG. 1 there is shown a perspective view of a string trimmer 10 incorporating features of the present invention. Although the present invention will be described with reference to the embodiments shown in the drawings, it should be understood that the present invention can be embodied in various different types and kinds of alternate embodiments. The present invention may also be embodied in different types of power driven tools including, but not limited to, chain saws, hedge trimmers, fluid pumps, leaf blowers, demolition saws, lawn mowers, or any other type of tool or machine driven by an internal combustion engine. In addition, any suitable size, shape, or type of elements or materials could be used.

The string trimmer 10 includes a cutting head 12, a shaft 14, a front handle 16, a rear handle 18 with throttle trigger 20, and an internal combustion engine 22. String trimmers are well known in the art. The only difference between the string trimmer 10 and known string trimmers is in the engine 22. Therefore, the known conventional features of the string trimmer will not be described in any further detail.

Referring also to FIGS. 2 and 3, the engine 22 is a two stroke engine with a cylinder 24, a piston 26, and a muffler 28. The engine 10 obviously has features such as a gas tank, carburetor, air filter, etc. which are conventional and need not be further described. The cylinder 24 has a piston cylinder space 30 in which the piston 26 reciprocally moves. The cylinder 24, in the embodiment shown, includes an air and fuel inlet port (not shown), a main exhaust port 32, and a compression release port 34. A spark plug 36 is connected to the cylinder 24 at a top end 38 of the cylinder 24. In the embodiment shown, the cylinder 24 is a one piece member, but in alternate embodiments it may be comprised of multiple members connected to each other. The cylinder 24 has a muffler mounting section that includes a first portion 40 and a second portion 42. The first portion 40 has the main exhaust port 32 extending therethrough. The first and second portions 40, 42 are separated or spaced from each other along the length of the cylinder. In the embodiment shown, the first and second portions are integrally formed with the cylinder. However, in alternate embodiments, the first and/or second portions could include a member or members that are attached to the cylinder. The entrance 44 to the compression release port 34 is located about half-way between the top 46 of the entrance 48 to the main exhaust port 32 and the upper most position of the top 50 of the piston 26 (also known as "top dead center"), illustrated by line A, as the piston reciprocates.

The compression release port 34 generally comprises a first small section 52 and a second enlarged section 54. In a preferred embodiment the length B of the first small section is smaller than the diameter C of the compression release port in the first small section 52. One example would comprise the diameter C as being 0.080 inch and the wall thickness or length B being 0.040 inch. However, other sizes and proportions could be provided in alternate embodiments. The second enlarged section 54 is preferably at least about 30 percent larger in diameter D than the diameter C. In the example given above, the diameter D would be about 0.125 inch. Although diameters are used above to describe the cross-sectional areas of sections 52 and 54, it should be understood that cross-sectional shapes could be provided other than circular.

The muffler 28 is of conventional design with one major exception. Instead of having a single inlet aperture for the main exhaust port, the muffler 28 has two inlet apertures; a first inlet aperture 56 and a second inlet aperture 58. The muffler 28 is fixedly attached to the cylinder 24 at the first portion 40 of the muffler mounting section by use of suitable fasteners (not shown) such as screws. A gasket 60 is located between the muffler 28 and the cylinder 24. The main exhaust port 32 communicates to the first inlet aperture 56. The second portion 42 of the muffler mounting section is provided as a boss that the muffler and gasket press against. The compression release port 34 communicates to the second inlet aperture 58. In an alternate embodiment the muffler could alternatively or additionally be directly fixedly connected to second portion 42 by additional fasteners. In addition, any suitable means to connect the muffler to the cylinder could be used.

During starting of the engine 22 a portion of the compression of air and fuel in the area 30 is intentionally lost through the port 34 as the piston 26 moves upward towards the spark plug 36.

This intentional loss of compression makes the engine easier to start with a pull starter or electric starter. As the piston 26 moves up, it eventually passes the entrance 44 to the port 34 thereby closing the release port 34. This occurs when the top 50 of the piston 26 passes the point E, about halfway between point A and the top 46 of the main exhaust port entrance 48. If the port 34 was not present, the compression would be about twice what it is for the engine 22. Thus, the actual compression for the engine 22 is about half of the compression of what the engine would have had without the port 34 being present. When the engine starts, the piston 26 is driven down from point A opening the release port 34 when the top 50 reaches point E. Some flow from the power pulse escapes through the release port 34. This escape causes a slight power loss, but the loss is substantially small because the most useful part of the power pulse has already been completed before this point. The flow rate allowed by the port 34, which is sufficient for the low pressure/low velocity escape during compression, is not enough to allow substantial loss of power at the high pressure/high velocity flow from a live power pulse. This feature of flow rate control is accomplished by two factors; the size of the hole 34 relative to the size of the area 30 and its location along the length of the cylinder area 30. The present invention allows much easier starting of the engine with no significant loss in power and, also without significant increase in emissions. It has been found that the size of the compression release hole 34 should be designed to be proportionally sized relative to the engine displacement. Preferably, the ratio of engine displacement to the cross-sectional area of the compression release port at small section 52 should be about 750:1. With this ratio, power loss is insignificant, emissions are kept low, and starting of the engine is nonetheless much easier. It has been found that an engine with a ratio of about 300:1 can have significant power loss. Although a preferred ratio of about 750:1 has been described above, other suitable ratios, such as ranging from about 850:1 to about 650:1, could be used. Multiple compression release ports could also be used including staggered along the length of the cylinder 24. Multiple compression release ports could also have different sizes.

Another feature of the present invention is the inherent resistance to clogging of the release port 34 and ease of cleaning of the release port 34 if it does become clogged. During use of prior known engines with compression release ports, carbon eventually builds up in the release ports and blocks the ports. To repair the blocked release port, a tool such as a drill or pin has to be used to open the release port. The present invention uses the relatively small length B and enlarged diameter D to help prevent carbon from blocking the port 34. However, even with the improved design described above, carbon may nonetheless build up in port 34 over a long period of time thereby blocking the port. The present invention, by merely removing the muffler 28, allows easy access to the release port 34 for cleaning and/or use of a properly sized pin to push out the carbon.

Another feature of this system is the low cost to manufacture and the ease to add to an existing cylinder design. An existing cylinder can be modified by adding a boss to the casting, drilling a through-hole for the first small section of the port, then end milling to a depth for the second enlarged section of the port. The only other modifications necessary are an additional hole in the muffler and muffler gasket for the port exhaust.

FIG. 4 shows an alternate embodiment. In the embodiment shown, the cylinder **24*a* has multiple compression release ports 34*a*, 34*b*. The ports have different sizes and are spaced along the length of the cylinder 24*a***. In this embodiment, the ports are closed and opened sequentially as the piston moved up and down. This type of embodiment can be used for larger size engines. The ports could also be located at the same location of the cylinder, merely being angularly spaced from each other. The ports could also have the same size. The present invention could also be used in four stroke engines.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A compression release system for an internal combustion engine comprising:

a cylinder of the engine having a first boss with a main exhaust port and a second boss with a separate compression release port; and a muffler connected to the cylinder on the bosses, the muffler having a first inlet aperture connected to the main exhaust port and a separate second inlet aperture connected to the compression release port.

2. A system as in claim 1 wherein the compression release port is located about half-way between a top of an entrance to the main exhaust port and an upper most position of a top of a piston of the engine.

3. A system as in claim 1 wherein the compression release port has a first small section at an entrance to the compression release port and a second enlarged section between the first small section and the second inlet aperture of the muffler.

4. A system as in claim 3 wherein the second enlarged section has a cross-sectional area about 30 percent larger than a cross-sectional area of the first enlarged section.

5. A system as in claim 3 wherein the length of the first small section is smaller than a diameter of the compression release port.

6. A system as in claim 5 wherein the length of the first section is about half the size of the diameter of the compression release port.

7. A system as in claim 1 wherein the compression release port is a straight channel through the second boss perpendicular to the cylinder and generally parallel to the main exhaust port in the first boss.

8. A system as in claim 1 wherein a displacement size of the engine and the cross-sectional size of the compression release port has a size ratio of between about 850:1 to about 650:1.

9. A system as in claim 8 wherein the size ratio is about 750:1.

10. A power driven tool having an internal combustion engine, the engine comprising:

a cylinder having a muffler mounting section, the muffler mounting section having a main exhaust port extending through a first boss portion and a compression release port extending through a second boss portion, the first and second boss portions being spaced from each other; and a muffler connected to the cylinder on the first and second boss portions, the muffler having a first inlet aperture connected to the main exhaust port and a second inlet aperture connected to the compression release port.

11. A tool as in claim 10 wherein the muffler is fixedly attached to the first boss portion of the muffler mounting section.

12. A tool as in claim 10 wherein the compression release port is located about half-way between top of an entrance to the main exhaust port and an upper most position of a top of a piston of the engine.

13. A tool as in claim 10 wherein the compression release port has a first small section at an entrance to the compression release port and a second enlarged section between the first small section and the second inlet aperture of the muffler.

14. A tool as in claim 13 wherein the second enlarged section has a cross-sectional area about 30 percent larger than a cross-sectional area of the first enlarged section.

15. A tool as in claim 13 wherein the length of the first small section is smaller than a diameter of the compression release port.

16. A tool as in claim 15 wherein the length of the first section is about half the size of the diameter of the compression release port.

17. A system as in claim 11 wherein the compression release port is a straight channel through the second boss portion perpendicular to the cylinder and generally parallel to the main exhaust port in the first boss portion.

18. A system as in claim 10 wherein a displacement size of the engine and the cross-sectional size of the compression release port has a size ratio of between about 650:1 to about 850:1.

19. A system as in claim 18 wherein the size ratio is about 750:1.

20. In a compression release system for an internal combustion engine, the system having a compression release port extending from a cylinder of the engine, the improvement comprising:

a size ratio of a displacement size of the engine to a cross-sectional size of the compression release port being between about 650:1 to about 850:1.

21. A system as in claim 20 wherein the size ratio is about 750:1.

22. A system as in claim 21 wherein the compression release port is located about half-way between a top of an entrance to a main exhaust port and an upper most position of a top of a piston of the engine.

23. A system as in claim 20 wherein the compression release system comprises multiple compression release ports for the cylinder.

24. A system as in claim 23 wherein the ports are spaced along a length of the cylinder.

25. In an internal combustion engine having a cylinder with a compression release system, the improvement comprising:

the cylinder having a main exhaust port, a first compression release port, and a second compression release port, wherein all of the ports are separate and spaced from each other and, extend through a wall of the cylinder into a single piston cylinder space.

26. An engine as in claim 25 wherein the ports are spaced from each other along the length of the cylinder.

* * * * *